US005607828A

United States Patent [19]

Maskasky

[11] Patent Number: 5,607,828

[45] Date of Patent: Mar. 4, 1997

[54] HIGH CHLORIDE {100} TABULAR GRAIN EMULSIONS IMPROVED BY PEPTIZER MODIFICATION

[75] Inventor: Joe E. Maskasky, Rochester, N.Y.

[73] Assignee: Eastman Kodak Company, Rochester, N.Y.

[21] Appl. No.: 663,820

[22] Filed: Jun. 14, 1996

[51] Int. Cl.[6] ..... G03C 1/035; G03C 1/015

[52] U.S. Cl. ..... 430/567; 430/569; 430/639; 430/641

[58] Field of Search ..... 430/567, 639, 430/641, 569

[56] References Cited

U.S. PATENT DOCUMENTS

| | | | |
|---|---|---|---|
| 2,343,650 | 3/1944 | Fallesen | 430/639 |
| 3,649,287 | 3/1972 | DePauw et al. | 430/569 |
| 4,439,520 | 3/1984 | Kofron et al. | 430/434 |
| 5,264,337 | 11/1993 | Maskasky | 430/567 |
| 5,284,744 | 2/1994 | Maskasky | 430/569 |
| 5,292,632 | 3/1994 | Maskasky | 430/567 |
| 5,310,635 | 5/1994 | Szajewski | 430/567 |
| 5,314,798 | 5/1994 | Brust et al. | 430/567 |
| 5,320,938 | 6/1994 | House et al. | 430/567 |
| 5,413,904 | 5/1995 | Chang et al. | 430/569 |

OTHER PUBLICATIONS

Mees *The Theory of the Photographic Process,* Revised Ed., Macmillan, 1951, pp. 48–49.

James *The Theory of the Photographic Process,* 4th Ed., Macmillan, 1977, p. 51.

*Research Disclosure,* vol. 365, Sep. 1994, Item 36544, II.

*Research Disclosure,* vol. 176, Dec. 1978, Item 17643, IX.

*Research Disclosure,* vol. 308, Dec. 1989, Item 308119, IX.

*Primary Examiner*—Mark F. Huff

*Attorney, Agent, or Firm*—Carl O. Thomas

[57] ABSTRACT

A radiation-sensitive emulsion comprised of silver halide grains including tabular grains (a) having {100} major faces, (b) containing greater than 50 mole percent chloride, based on silver, (c) accounting for greater than 30 percent of total grain projected area, (d) exhibiting an average thickness of less than 0.3 μm, and (e) exhibiting an average aspect ratio of greater than 5, and a dispersing medium including a peptizer adsorbed to the silver halide grains, wherein the peptizer is a water dispersible oxidized cationic starch.

19 Claims, No Drawings

HIGH CHLORIDE {100} TABULAR GRAIN EMULSIONS IMPROVED BY PEPTIZER MODIFICATION

CROSS REFERENCE TO RELATED APPLICATION

Reference is made to and priority claimed from U.S. Provisional application Ser. No. 60/007,042, filed 25 Oct. 1995, entitled HIGH CHLORIDE {100} TABULAR GRAIN EMULSIONS IMPROVED BY PEPTIZER MODIFICATION.

FIELD OF THE INVENTION

The invention is directed to photographic emulsions. More specifically, the invention is directed to high chloride {100} tabular grain emulsions containing modified peptizers.

DEFINITION OF TERMS

The term "equivalent circular diameter" or "ECD" is employed to indicate the diameter of a circle having the same projected area as a silver halide grain.

The term "aspect ratio" designates the ratio of grain ECD to grain thickness (t).

The term "tabularity" is defined as $ECD/t^2$, where ECD and t are both measured in micrometers (μm).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 30 percent of total grain projected area.

The term "high bromide" or "high chloride" in referring to grains and emulsions indicates that bromide or chloride, respectively, are present in concentrations of greater than 50 mole percent, based on total silver.

In referring to grains and emulsions containing two or more halides, the halides are named in order of ascending concentrations.

The term "{100} tabular" is employed in referring to tabular grains and tabular grain emulsions in which the tabular grains have {100} major faces.

The term "gelatino-peptizer" is employed to designate gelatin and gelatin-derived peptizers.

The terms "selected oxidized cationic starch peptizer" and "selected peptizer" are employed to designate a water dispersible oxidized cationic starch.

The term "oxidized" in referring to starch indicates a starch in which, on average, at least one α-D-glucopyranose repeating unit per starch molecule has been ring opened by cleavage of the 2 to 3 ring position carbon-to-carbon bond.

The term "cationic" in referring to starch indicates that the starch molecule has a net positive charge at the pH of intended use.

The term "water dispersible" in referring to cationic starches indicates that, after boiling the cationic starch in water for 30 minutes, the water contains, dispersed to at least a colloidal level, at least 1.0 percent by weight of the total cationic starch.

The term "middle chalcogen" designates sulfur, selenium and/or tellurium.

All references to periods and groups within the periodic table of elements are based on the format of the periodic table adopted by the American Chemical Society and published in the *Chemical and Engineering News*, Feb. 4, 1985, p. 26. In this form the prior numbering of the periods was retained, but the Roman numeral numbering of groups and the A and B group designations (having opposite meanings in the U.S. and Europe) were replaced by a simple left to right 1 through 18 numbering of the groups.

The term "Group VIII metal" refers to an element from period 4, 5 or 6 and any one of groups 8 to 10 inclusive.

*Research Disclosure* is published by Kenneth Mason Publications, Ltd., Dudley House, 12 North St., Emsworth, Hampshire P010 7DQ, England.

BACKGROUND

Photographic emulsions are comprised of a dispersing medium and silver halide microcrystals, commonly referred to as grains. As the grains are precipitated from an aqueous medium, a peptizer, usually a hydrophilic colloid, is adsorbed to the grain surfaces to prevent the grains from agglomerating. Subsequently binder is added to the emulsion and, after coating, the emulsion is dried. The peptizer and binder are collectively referred to as the photographic vehicle of an emulsion.

Gelatin and gelatin derivatives form both the peptizer and the major portion of the remainder of the vehicle in the overwhelming majority of silver halide photographic elements. An appreciation of gelatin is provided by this description contained in Mees *The Theory of the Photographic Process*, Revised Ed., Macmillan, 1951, pp. 48 and 49:

> Gelatin is pre-eminently a substance with a history; its properties and its future behavior are intimately connected with its past. Gelatin is closely akin to glue. At the dawn of the Christian era, Pliny wrote, "Glue is cooked from the hides of bulls." It is described equally shortly by a present-day writer as "the dried down soup or consommé of certain animal refuse." The process of glue making is age-old and consists essentially in boiling down hide clippings or bones of cattle and pigs. The filtered soup is allowed to cool and set to a jelly which, when cut and dried on nets, yields sheets of glue or gelatin, according to the selection of stock and the process of manufacture. In the preparation of glue, extraction is continued until the ultimate yield is obtained from the material; in the case of gelatin, however, the extraction is halted earlier and is carried out at lower temperatures, so that certain strongly adhesive but nonjelling constituents of glue are not present in gelatin. Glue is thus distinguished by its adhesive properties; gelatin by its cohesive properties, which favor the formation of strong jellies.

Photographic gelatin is generally made from selected clippings of calf hide and ears as well as cheek pieces and pates. Pigskin is used for the preparation of some gelatin, and larger quantities are made from bone. The actual substance in the skin furnishing the gelatin is collagen. It forms about 35 percent of the coria of fresh cattle hide. The corresponding tissue obtained from bone is termed ossein. The raw materials are selected not only for good structural quality but for freedom from bacterial decomposition. In preparation for the extraction, the dirt with loose flesh and blood is eliminated in a preliminary wash. The hair, fat, and much of the albuminous materials are removed by soaking the stock in limewater containing suspended lime. The free lime continues to rejuvenate the solution and keeps the bath at suitable alkalinity. This operation is followed by deliming with dilute acid, washing, and cooking to extract the gelatin. Several "cooks" are made at increasing temperatures, and usually the products of the last extractions are not employed for photographic gelatin. The crude gelatin solution is filtered, concentrated if necessary, cooled until it sets, cut up, and dried in slices. The residue, after extraction of the gelatin, consists chiefly of elastin and reticulin with some keratin and albumin.

Gelatin may also be made by an acid treatment of the stock without the use of lime. The stock is treated with dilute acid (pH 4.0) for one to two months and then washed thoroughly, and the gelatin is extracted. This gelatin differs in properties from gelatin made by treatment with lime.

In addition to the collagen and ossein sought to be extracted in the preparation of gelatin there are, of course, other materials entrained. For example, James *The Theory of the Photographic Process,* 4th Ed., Macmillan, 1977, p. 51, states:

Although collagen generally is the preponderant protein constituent in its tissue of origin, it is always associated with various "ground substances" such as noncollagen protein, mucopolysaccharides, polynucleic acid, and lipids. Their more or less complete removal is desirable in the preparation of photographic gelatin.

Superimposed on the complexity of composition is the variability of composition, attributable to the varied diets of the animals providing the starting materials. The most notorious example of this was provided by the forced suspension of manufacturing by the Eastman Dry Plate Company in 1882, ultimately attributed to a reduction in the sulfur content in a purchased batch of gelatin.

Considering the time, effort, complexity and expense involved in gelatin preparation, it is not surprising that research efforts have in the past been mounted to replace the gelatin used in photographic emulsions and other film layers. However, by 1970 any real expectation of finding a generally acceptable replacement for gelatin had been abandoned. A number of alternative materials have been identified as having peptizer utility, but none have found more than limited acceptance. Of these, cellulose derivatives are by far the most commonly named, although their use has been restricted by the insolubility of cellulosic materials and the extensive modifications required to provide peptizing utility.

*Research Disclosure,* Vol. 365, Sept. 1994, Item 36544, II. Vehicles, vehicle extenders, vehicle-like addenda and vehicle related addenda, A. Gelatin and hydrophilic colloid peptizers, paragraph (1) states:

(1) Photographic silver halide emulsion layers and other layers on photographic elements can contain various colloids alone or in combination as vehicles. Suitable hydrophilic materials include both naturally occurring substances such as proteins, protein derivatives, cellulose derivatives—e.g., cellulose esters, gelatin—e.g., alkali-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin and the like . . . .

This description is identical to that contained in *Research Disclosure,* Vol. 176, December 1978, Item 17643, IX. Vehicles and vehicle extenders, paragraph A.

During the 1980's a marked advance took place in silver halide photography based on the discovery that a wide range of photographic advantages, such as improved speed-granularity relationships, increased covering power, both on an absolute basis and as a function of binder hardening, more rapid developability, increased thermal stability, increased separation of native and spectral sensitization imparted imaging speeds, and improved image sharpness in both mono- and multi-emulsion layer formats, can be realized by increasing the proportions of tabular grain populations in photographic emulsions.

In descriptions of these emulsions, as illustrated by Kofron et al U.S. Pat. No. 4,439,520, the vehicle disclosure of *Research Disclosure* Item 17643 was incorporated verbatim. Only gelatin peptizers were actually demonstrated in the Examples.

A difficulty that persisted throughout the 1980's was that no technique was known for preparing high chloride {100} tabular grain emulsions. It is known that high chloride emulsions possess performance advantages over high bromide emulsions in that high chloride emulsions (1) possess little, if any, native sensitivity to the visible spectrum, thereby allowing a more selective response when spectrally sensitized to a selected visible spectral region, (2) can be processed much more rapidly than high bromide emulsions, (3) require less frequent replenishment of processing solutions, and (4) pose less of a ecological burden than high bromide emulsions upon disposal.

The morphological instability of high chloride tabular grain emulsions with {111} major faces, the only emulsions available in the 1980's, limited the use of high chloride tabular grain emulsions. The recent discovery Of high chloride {100} tabular grain emulsions is illustrated by Maskasky U.S. Pat. Nos. 5,264,337 and 5,292,632, Szajewski U.S. Pat. No. 5,310,635, Brust et al U.S. Pat. No. 5,314,798, House et al U.S. Pat. No. 5,320,938, and Chang et al U.S. Pat. No. 5,413,904. While only gelatino-peptizers are actually demonstrated, all conventional peptizers of the types disclosed in *Research Disclosure,* Vol. 308, December 1989, Item 308119, Section IX, which is similar to *Research Disclosure* Item 17643, cited above, are stated to be useful.

Maskasky U.S. Pat. No. 5,284,744 taught the use of potato starch as a peptizer for the preparation of cubic (i.e., (100)) grain silver halide emulsions, noting that potato starch has a lower absorption, compared to gelatin, in the wavelength region of from 200 to 400 nm. Maskasky '744 does not disclose tabular grain emulsions.

RELATED PROVISIONAL APPLICATIONS

Maskasky U.S. Ser. No. 08/643,225, filed May 2, 1996, titled HIGH BROMIDE TABULAR GRAIN EMULSIONS IMPROVED BY PEPTIZER SELECTION, commonly assigned, is directed to high bromide {111} tabular grain emulsions in which the peptizer is a water dispersible cationic starch. Priority is claimed from Jul. 27, 1995.

Maskasky U.S. Ser. No. 60/001,580, filed Jul. 27, 1995, titled HIGH BROMIDE ULTRATHIN TABULAR GRAIN EMULSIONS IMPROVED BY PEPTIZER SELECTION, commonly assigned, is directed to high bromide ultra-thin {111} tabular grain emulsions in which the peptizer is a water dispersible cationic starch.

Maskasky U.S. Ser. No. 60/002,089, filed Aug. 10, 1995, commonly assigned, titled PHOTOGRAPHIC EMULSIONS IMPROVED BY PEPTIZER MODIFICATION, is directed to radiation-sensitive silver halide emulsions containing oxidized cationic starch as a peptizer.

Maskasky U.S. Ser. No. 60/002,101, filed Aug. 10, 1995, commonly assigned, titled HIGH BROMIDE ULTRATHIN TABULAR GRAIN EMULSIONS IMPROVED BY PEP- TIZER MODIFICATION, is directed to high bromide ultrathin {111} tabular grain emulsions in which the peptizer is an oxidized water dispersible cationic starch.

Maskasky U.S. Ser. No. 60/002,105, filed Aug. 10, 1995, commonly assigned, titled DUAL COATED RADIOGRAPHIC ELEMENTS CONTAINING TABULAR GRAIN EMULSIONS WITH IMPROVED PHOTOGRAPHIC VEHICLES, is directed to dual coated radiographic elements containing at least one high bromide {111} tabular grain emulsion and a hydrophilic colloid derived from a water dispersible cationic starch.

SUMMARY OF THE INVENTION

In one aspect this invention is directed to a radiation-sensitive emulsion comprised of silver halide grains including tabular grains (a) having {100} major faces, (b) containing greater than 50 mole percent chloride, based on silver, (c) accounting for greater than 30 percent of total grain projected area, (d) exhibiting an average thickness of less than 0.3 μm, and (e) exhibiting an average aspect ratio of greater than 5, and a dispersing medium including a peptizer adsorbed to the silver halide grains, wherein the peptizer is a water dispersible oxidized cationic starch.

The invention has arisen out of the following course of investigations: Attempts to prepare tabular grain emulsions employing charge neutral (including zwitterionic) and anionic starches were unsuccessful. Subsequently it was discovered that cationic starches could be employed to prepare high bromide {111} tabular grain emulsions, but that high chloride tabular grain emulsions could not be prepared employing cationic starches as peptizers. Thereafter it was discovered that oxidized cationic starches represent an improvement over cationic starches as peptizers and that {111} high bromide tabular grain emulsions can be prepared employing oxidized cationic starches.

It has now been discovered that high chloride {100} tabular grain emulsions can be prepared employing oxidized cationic starches as peptizers.

In the course of these investigations it has been discovered quite surprisingly that oxidized cationic starches are better suited for preparing tabular grain emulsions than conventional peptizers and particularly gelatino-peptizers. Oxidized cationic peptizers exhibit lower levels of viscosity than have previously been present in preparing tabular grain emulsions. Reduced viscosity facilitates more uniform mixing. Both micromixing, which controls the uniformity of grain composition, mean grain size and dispersity, and bulk mixing, which controls scale up of precipitations to convenient manufacturing scales, are favorably influenced by the reduced viscosities made possible by oxidized cationic starch peptizers. Precise control over grain nucleation, including the monodispersity of the grain nuclei, is particularly important to successfully achieving and improving the properties of tabular grain emulsions. The oxidation of the cationic starch itself is beneficial in the elimination of potentially harmful impurities from the peptizer composition.

Under comparable conditions of chemical sensitization higher photographic speeds can be realized with oxidized cationic starches. It is possible to achieve comparable levels of chemical sensitization with lesser combinations of sensitizers. Lower temperatures can be employed during chemical sensitization of oxidized cationic starch peptized emulsions to achieve photographic speeds equal or superior to those of conventionally peptized emulsions. Lower temperatures can be employed during chemical sensitization of oxidized cationic starch peptized tabular grain emulsions to achieve photographic speeds equal or superior to those of gelatino-peptized ultrathin tabular grain emulsions. Oxidized cationic starch peptized emulsions can, in fact, be chemically sensitized at temperatures that are too low to permit the chemical sensitization of gelatino-peptized silver halide emulsions. Further, oxidized cationic starch peptizers allow lower temperatures to be employed during grain precipitation. Lower temperatures have the advantage of protecting the tabular grains from unwanted ripening, particularly thickening, during precipitation and/or chemical sensitization.

DESCRIPTION OF PREFERRED EMBODIMENTS

The present invention is generally applicable to high chloride {100} tabular grain emulsions. The emulsions are specifically contemplated for incorporation in color and black-and-white reflection print elements—i.e., those that form images that are intended to be viewed directly. The invention is also applicable to camera speed photographic films, including both color and black-and-white photographic films. In addition the emulsions are specifically contemplated for incorporation in radiographic films, including dualscoated films, those that coat emulsion layers on opposite sides of a film support.

The high chloride ultrathin {100} tabular grain emulsions of the invention are comprised of silver halide grains including tabular grains (a) having (100) major faces, (b) containing greater than 50 mole percent chloride, based on silver, (c) accounting for greater than 30 percent of total grain projected area, (d) exhibiting an average thickness of less than 0.3 μm, and (e) exhibiting an average aspect ratio of greater than 5.

The emulsions of the present invention can be readily distinguished from conventional high chloride ultrathin {100} tabular grain emulsions, such as those disclosed by Maskasky, Szajewski, Brust et al and House et al, cited above, in that a water dispersible oxidized cationic starch is adsorbed to the grain surfaces, thereby acting as a peptizer. Any conventional water dispersible starch that has been oxidized and modified to contain cationic substituents can be employed as a peptizer.

The term "starch" is employed to include both natural starch and modified derivatives, such as dextrinated, hydrolyzed, alkylated, hydroxyalkylated, acetylated or fractionated starch. The starch can be of any origin, such as corn starch, wheat starch, potato starch, tapioca starch, sago starch, rice starch, waxy corn starch (which consists essentially of amylopectin) or high amylose corn starch.

Starches are generally comprised of two structurally distinctive polysaccharides, α-amylose and amylopectin. Both are comprised of α-D-glucopyranose units. In α-amylose the α-D-glucopyranose units form a 1,4-straight chain polymer. The repeating units take the following form:

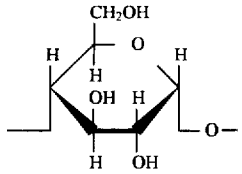

(I)

In amylopectin, in addition to the 1,4-bonding of repeating units, 6-position chain branching (at the site of the —$CH_2OH$ group above) is also in evidence, resulting in a branched chain polymer. The repeating units of starch and cellulose are diasteroisomers that impart different overall geometries to the molecules. The α anomer, found in starch and shown in formula I above, results in a polymer that is capable of crystallization and some degree of hydrogen bonding between repeating units in adjacent molecules, not to the same degree as the β anomer repeating units of cellulose and cellulose derivatives. Polymer molecules formed by the β anomers show strong hydrogen bonding between adjacent molecules, resulting in clumps of polymer molecules and a much higher propensity for crystallization. Lacking the alignment of substituents that favors strong intermolecular bonding, found in cellulose repeating units, starch and starch derivatives are much more readily dispersed in water.

The water dispersible starches employed in the practice of the invention are cationic—that is, they contain an overall net positive charge when dispersed in water. Starches are conventionally rendered cationic by attaching a cationic substituent to the α-D-glucopyranose units, usually by esterification or etherification at one or more free hydroxyl sites. Reactive cationogenic reagents typically include a primary, secondary or tertiary amino group (which can be subsequently protonated to a cationic form under the intended conditions of use) or a quaternary ammonium, sulfonium or phosphonium group.

To be useful as a peptizer the cationic starch must be water dispersible. Many starches disperse in water upon heating to temperatures up to boiling for a short time (e.g., 5 to 30 minutes). High sheer mixing also facilitates starch dispersion. The presence of cationic substituents increases the polar character of the starch molecule and facilitates dispersion. The starch molecules preferably achieve at least a colloidal level of dispersion and ideally are dispersed at a molecular level—i.e., dissolved.

The following teachings, the disclosures of which are here incorporated by reference, illustrate water dispersible cationic starches within the contemplation of the invention:

*Rutenberg et al U.S. Pat. No. 2,989,520;
Meisel U.S. Pat. No. 3,017,294;
Elizer et al U.S. Pat. No. 3,051,700;
Aszolos U.S. Pat. No. 3,077,469;
Elizer et al U.S. Pat. No. 3,136,646;
*Barber et al U.S. Pat. No. 3,219,518;
*Mazzarella et al U.S. Pat. No. 3,320,080;
Black et al U.S. Pat. No. 3,320,118;
Caesar U.S. Pat. No. 3,243,426;
Kirby U.S. Pat. No. 3,336,292;
Jarowenko U.S. Pat. No. 3,354,034;
Caesar U.S. Pat. No. 3,422,087;
*Dishburger et al U.S. Pat. No. 3,467,608;
*Beaninga et al U.S. Pat. No. 3,467,647;
Brown et al U.S. Pat. No. 3,671,310;
Cescato U.S. Pat. No. 3,706,584;
Jarowenko et al U.S. Pat. No. 3,737,370;
*jarowenko U.S. Pat. No. 3,770,472;
Moser et al U.S. Pat. No. 3,842,005;
Tessler U.S. Pat. No. 4,060,683;
Rankin et al U.S. Pat. No. 4,127,563;
Huchette et al U.S. Pat. No. 4,613,407;
Blixt et al U.S. Pat. No. 4,964,915;
*Tsai et al U.S. Pat. No. 5,227,481; and
*Tsai et al U.S. Pat. No. 5,349,089.

The starch can be oxidized either before (* patents above) or following the addition of cationic substituents. This is accomplished by treating the starch with a strong oxidizing agent. Both hypochlorite ($ClO^-$) or periodate ($IO_4^-$) have been extensively used and investigated in the preparation of commercial starch derivatives and are preferred. While any convenient counter ion can be employed, preferred counter ions are those fully compatible with silver halide emulsion preparation, such as alkali and alkaline earth cations most commonly sodium, potassium or calcium.

When the oxidizing agent opens the α-D-glucopyranose ring, the oxidation sites are at the 2 and 3 position carbon atoms forming the α-D-glucopyranose ring. The 2 and 3 position

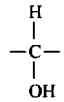

groups are commonly referred to as the glycol groups. The carbon-to-carbon bond between the glycol groups is replaced in the following manner:

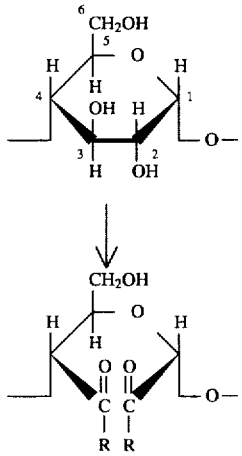

(II)

where R represents the atoms completing an aldehyde group or a carboxyl group.

The hypochlorite oxidation of starch is most extensively employed in commercial use. The hypochlorite is used in small quantities to modify impurities in starch. Any modification of the starch at these low levels is minimal, at most affecting only the polymer chain terminating aldehyde groups, rather than the α- D-glucopyranose repeating units themselves. At levels of oxidation that affect the α-D-glucopyranose repeating units the hypochlorite affects the 2, 3 and 6 positions, forming aldehyde groups at lower levels of oxidation and carboxyl groups at higher levels of oxidation. Oxidation is conducted at mildly acidic and alkaline pH (e.g., >5 to 11). The oxidation reaction is exothermic, requiring cooling of the reaction mixture. Temperatures of less than 45° C. are preferably maintained. Using a hypobromite oxidizing agent is known to produce similar results as hypochlorite.

Hypochlorite oxidation is catalyzed by the presence of bromide ions. Since high chloride silver halide emulsions are often precipitated in the presence of bromide, it is specifically contemplated to add bromide ion to the starch prior to performing the oxidation step in the concentrations known to be useful in these precipitations. Higher levels of bromide can also be present during oxidation and washed out of the oxidized starch prior to emulsion precipitation.

Cescato U.S. Pat. No. 3,706,584, the disclosure of which is here incorporated by reference, discloses techniques for the hypochlorite oxidation of cationic starch. Sodium bromite, sodium chlorite and calcium hypochlorite are named as alternatives to sodium hypochlorite. Further teachings of the hypochlorite oxidation of starches is provided by the following: R. L. Whistler, E. G. Linke and S. Kazeniac, "Action of Alkaline Hypochlorite on Corn Starch Amylose and Methyl 4-O-Methyl-D-glucopyranosides", *Journal Amer. Chem. Soc.*, Vol. 78, pp. 4704–9 (1956); R. L. Whistler and R. Schweiger, "Oxidation of Amylopectin with Hypochlorite at Different Hydrogen Ion Concentrations, *Journal Amer. Chem. Soc.*, vol. 79, pp. 6460–6464 (1957); J. Schmorak, D. Mejzler and M. Lewin, "A Kinetic Study of the Mild Oxidation of Wheat Starch by Sodium Hypochloride in the Alkaline pH Range", *Journal of Polymer Science*, Vol. XLIX, pp. 203–216 (1961); J. Schmorak and M. Lewin, "The Chemical and Physico-chemical Properties of Wheat Starch with Alkaline Sodium Hypochlorite", *Journal of Polymer Science:Part A*, Vol. 1, pp. 2601–2620 (1963); K. F. Patel, H. U. Mehta and H. C. Srivastava, "Kinetics and Mechanism of Oxidation of Starch with Sodium Hypochlorite", *Journal of Applied Polymer Science*, Vol. 18, pp. 389–399 (1974); R. L. Whistler, J. N. Bemiller and E. F. Paschall, *Starch: Chemistry and Technology*, Chapter X, Starch Derivatives: Production and Uses, II. Hypochlorite-Oxidized Starches, pp. 315–323, Academic Press, 1984; and O. B. Wurzburg, *Modified Starches: Properties and Uses*, III. Oxidized or Hypochlorite-Modified Starches, pp. 23–28 and pp. 245–246, CRC Press (1986). Although hypochlorite oxidation is normally carried out using a soluble salt, the free acid can alternatively be employed, as illustrated by M. E. McKillican and C. B. Purves, "Estimation of Carboxyl, Aldehyde and Ketone Groups in Hypochlorous Acid Oxystarches", *Can. J. Chem.*, Vol. 312–321 (1954).

Periodate oxidizing agents are of particular interest, since they are known to be highly selective. The periodate oxidizing agents produce starch dialdehydes by the reaction shown in the formula (II) above without significant oxidation at the site of the 6 position carbon atom. Unlike hypochlorite oxidation, periodate oxidation does not produce carboxyl groups and does not produce oxidation at the 6 position. Mehltretter U.S. Pat. No. 3,251,826, the disclosure of which is here incorporated by reference, discloses the use of periodic acid to produce a starch dialdehyde which is subsequently modified to a cationic form. Mehltretter also discloses for use as oxidizing agents the soluble salts of periodic acid and chlorine. Further teachings of the periodate oxidation of starches is provided by the following: V. C. Barry and P. W. D. Mitchell, "Properties of Periodate-oxidized Polysaccharides. Part II. The Structure of some Nitrogen-containing Polymers", *Journal Amer. Chem. Soc.*, 1953, pp. 3631–3635; P. J. Borchert and J. Mirza, "Cationic Dispersions of Dialdehyde Starch I. Theory and Preparation", *Tappi*, Vol. 47, No. 9, pp. 525–528 (1964); J. E. McCormick, "Properties of Periodate-oxidized Polysaccharides. Part VII. The Structure of Nitrogen-containing Derivatives as deduced from a Study of Monosaccharide Analogues", *Journal Amer. Chem. Soc.*, pp. 2121–2127 (1966); and O. B. Wurzburg, *Modified Starches: Properties and Uses*, III. Oxidized or Hypochlorite-Modified Starches, pp. 28–29, CRC Press (1986).

Starch oxidation by electrolysis is-disclosed by F. F. Farley and R. M. Hixon, "Oxidation of Raw Starch Granules by Electrolysis in Alkaline Sodium Chloride Solution", *Ind. Eng. Chem.*, Vol. 34, pp. 677–681 (1942).

Depending upon the choice of oxidizing agents employed, one or more soluble salts may be released during the oxidation step. Where the soluble salts correspond to or are similar to those conventionally present during silver halide precipitation, the soluble salts need not be separated from the oxidized starch prior to silver halide precipitation. It is, of course, possible to separate soluble salts from the oxidized cationic starch prior to precipitation using any conventional separation technique. For example, removal of halide ion in excess of that desired to be present during grain precipitation can be undertaken. Simply decanting solute and dissolved salts from oxidized cationic starch particles is a simple alternative. Washing under conditions that do not solubilize the oxidized cationic starch is another preferred option. Even if the oxidized cationic starch is dispersed in a solute during oxidation, it can be separated using conventional ultrafiltration techniques, since there is a large molecular size separation between the oxidized cationic starch and soluble salt by-products of oxidation.

The carboxyl groups formed by oxidation take the form —C(O)OH, but, if desired, the carboxyl groups can, by further treatment, take the form —C(O)OR', where R' represents the atoms forming a salt or ester. Any organic moiety added by esterification preferably contains from 1 to 6 carbon atoms and optimally from 1 to 3 carbon atoms.

The minimum degree of oxidation contemplated is that required to reduce the viscosity of the starch. It is generally accepted (see citations above) that opening an α-D-glucopyranose ring in a starch molecule disrupts the helical configuration of the linear chain of repeating units which in turn reduces viscosity in solution. It is contemplated that at least one α-D-glucopyranose repeating unit per starch polymer, on average, be ring opened in the oxidation process. As few as two or three opened α-D-glucopyranose rings per polymer has a profound effect on the ability of the starch polymer to maintain a linear helical configuration. It is generally preferred that at least 1 percent of the glucopyranose rings be opened by oxidation.

A preferred objective is to reduce the viscosity of the cationic starch by oxidation to less than four times (400 percent of) the viscosity of water at the starch concentrations employed in silver halide precipitation. Although this viscosity reduction objective can be achieved with much lower levels of oxidation, starch oxidations of up to 90 percent of the α-D-glucopyranose repeating units have been reported (Wurzburg, cited above, p. 29). However, it is generally preferred to avoid driving oxidation beyond levels required for viscosity reduction, since excessive oxidation results in increased chain cleavage. A typical convenient range of oxidation ring-opens from 3 to 50 percent of the α-D-glucopyranose rings.

The water dispersible oxidized cationic starch is present during the precipitation (during nucleation and grain growth or during grain growth) of the high chloride (100) tabular grains. Preferably precipitation is conducted by substituting the water dispersible cationic starch for all conventional gelatino-peptizers. In substituting the selected oxidized cationic starch peptizer for conventional gelatino-peptizers, the concentrations of the selected peptizer and the point or points of addition can correspond to those employed using gelatino-peptizers.

In addition, it has been unexpectedly discovered that emulsion precipitation can tolerate even higher concentrations of the selected peptizer. For example, it has been observed that all of the selected peptizer required for the preparation of an emulsion through the step of chemical sensitization can be present in the reaction vessel prior to grain nucleation. This has the advantage that no peptizer additions need be interjected after tabular grain precipitation has commenced. It is generally preferred that from 1 to 500 grams (most preferably from 5 to 100 grams) of the selected peptizer per mole of silver to be precipitated be present in the reaction vessel prior to tabular grain nucleation.

At the other extreme, it is, of course, well known, as illustrated by Mignot U.S. Pat. No. 4,334,012, here incorporatedby reference, that no peptizer is required to be present during grain nucleation, and, if desired, addition of the selected peptizer can be deferred until grain growth has progressed to the point that peptizer is actually required to avoid tabular grain agglomeration.

The procedures for high chloride (100) tabular grain emulsion preparation through the completion of tabular grain growth require only the substitution of the selected peptizer for conventional gelatino-peptizers. Thus, the procedures for preparing high chloride {100} tabular grain emulsions disclosed by Maskasky U.S. Pat. Nos. 5,264,337 and 5,292,632, Szajewski U.S. Pat. No. 5,310,635, Brust et al U.S. Pat. No. 5,314,798, House et al U.S. Pat. No. 5,320,938, Chang et al U.S. Pat. No. 5,413,904, and Budz et al U.S. Pat. No. 5,451,490, the disclosures of which are incorporated by reference. Precipitation techniques include those that employ iodide during grain nucleation (e.g., House et al) or immediately following grain nucleation (e.g., Chang et al) or that withhold the introduction of iodide during grain nucleation and rely instead upon adsorbed grain growth modifiers to provide the formation of high chloride {100} tabular grains (e.g., Maskasky). In addition, Maskasky U.S. Pat. No. 5,292,632 in Example 6 demonstrates that neither iodide nor a grain growth modifier are necessary to the precipitation of high chloride {100} tabular grain emulsions, although the percentage of total grain projected area accounted by high chloride {100} tabular grains is not as high as demonstrated with the other preparation techniques. The Examples below are more comparable to the Example 6 preparation technique than the other techniques noted. Hence, improvements in grain characteristics over those demonstrated in the Examples can be achieved by employing one or combination of iodide and/or a grain growth modifier. It is also believed that improved grain characteristics can also be realized by optimization of the Example 6 preparation technique, which has not as yet been undertaken.

The high chloride grain population contains at least 50 mole percent chloride, based on total silver forming the grain population (herein also referred to simply as total silver). Thus, the silver halide content of the grain population can consist essentially of silver chloride as the sole silver halide. Alternatively, the grain population can consist essentially of silver bromochloride, where bromide ion accounts for up to 50 mole percent of the silver halide, based on total silver. Preferred emulsions according to the invention contain less than 20 mole percent bromide, optimally less than 10 mole percent bromide, based on total silver. Silver iodochloride and silver iodobromochloride emulsions are also within the contemplation of the invention. It is well understood in the art that low bromide and/or iodide concentrations at grain surfaces can significantly improve the properties of the grains for photographic purposes such as spectral sensitization. Bromide and/or iodide added for the purpose of improving sensitization can usefully be precipitated onto the surface of a previously formed tabular grain population—e.g., a silver chloride tabular grain population. Significant photographic advantages can be realized with bromide or iodide concentrations as low as 0.1 mole percent, based on total silver, with minimum concentrations preferably being at least 0.5 mole percent.

To realize the advantages of tabular grain shape it is contemplated that the high chloride tabular grain population will be relatively thin. The tabular grain population has a mean thickness of less than 0.3 μm, and preferably less than 0.2 μm. Mean tabular grain thicknesses are generally at least 0.1 μm, but it is considered feasible to obtain mean thicknesses of less than 0.07 μm—that is, in the thickness range of ultrathin tabular grain emulsions.

It is contemplated that the tabular grain population satisfy at least the first and preferably both of the following relationships:

Average aspect ratio $$ECD/t>5 \quad \text{(III)}$$

and

Average tabularity $$ECD/t^2>25 \quad \text{(IV)}$$

where

ECD is the effective circular diameter of the tabular grains in micrometers (μm) and t is the thickness of the tabular grains in μm. In arriving at the average aspect ratio or average tabularity for a tabular grain population it is contemplated to average separately the ECD's and the thicknesses of the tabular grain population and then to obtain the quotient required by relationships III and IV.

Average aspect ratios of the tabular grain population are limited only by the maximum ECD that can be tolerated by photographic application contemplated for the emulsion. Generally acceptable imaging quality (granularity) can be realized with tabular grain mean ECD's ranging up to 10 μm. Mean tabular grain ECD's are typically less than 5 μm. Average aspect ratios ranging up to 50 can be readily realized, and higher average aspect ratios of up to 100 are believed to be achievable with optimized emulsion precipitations. Preferred emulsions are those in which the tabular grain population exhibits a high average aspect ratio—that is, greater than 8. Specifically preferred emulsions are high aspect ratio emulsions with average aspect ratios of up to about 20 or higher.

The emulsions of this invention preferably exhibit high average tabularities—that is, greater than 25. With the parameters of ECD, t and aspect ratio set forth above it is possible to provide emulsions with extremely high tabularities ranging up to 1000. Typically the emulsions of the invention exhibit average tabularities of up to 500 with tabularities of from >25 to 200 being readily achieved.

High chloride {100} tabular grains account for at least 30 percent of total grain projected area. It is, of course, preferred to maximize the percentage of total grain projected area accounted for by the high chloride {100} tabular grains as the grains are initially precipitated. Thus, high chloride {100} tabular grain projected areas of greater than 50 percent, greater than 70 percent and greater than 90 percent are progressively favored. In practice the percentage of the total grain projected area accounted for by high chloride {100} tabular grains can be reduced as a consequence of employing conventional rain blending techniques.

In one preferred form of the invention it is specifically contemplated to incorporate in the high chloride {100} tabular grains a dopant capable of increasing photographic speed by forming a shallow electron trap (hereinafter also referred to as a SET). When a photon is absorbed by a grain, an electron (hereinafter referred to as a photoelectron) is promoted from the valence band of the silver halide crystal lattice to its conduction band, creating a hole (hereinafter referred to as a photohole) in the valence band. To create a latent image site within the rain, a plurality of photoelectrons produced in a single imagewise exposure must reduce several silver ions in the crystal lattice to form a small cluster of Ag° atoms. To the extent that photoelectrons are dissipated by competing mechanisms before the latent image can form, the photographic sensitivity of the silver halide rains is reduced. For example, if the photoelectron returns to the photohole, its energy is dissipated without contributing to latent image formation.

It is contemplated to dope the rain to create within it shallow electron traps that contribute to utilizing photoelectrons for latent image formation with reater efficiency. This is achieved by incorporating in the face centered cubic crystal lattice a dopant that exhibits a net valence more positive than the net valence of the ion or ions it displaces in the crystal lattice. For example, in the simplest possible form the dopant can be a polyvalent (+2 to +5) metal ion that displaces silver ion ($Ag^+$) in the crystal lattice structure. The substitution of a divalent cation, for example, for the monovalent $Ag^+$ cation leaves the crystal lattice with a local net positive charge. This lowers the energy of the conduction band locally. The amount by which the local energy of the conduction band is lowered can be estimated by applying the effective mass approximation as described by J. F. Hamilton in the journal *Advances in Physics*, Vol. 37 (1988) p. 395 and *Excitonic Processes in Solids* by M. Ueta, H. Kanzaki, K. Kobayashi, Y. Toyozawa and E. Hanamura (1986), published by Springer-Verlag, Berlin, p. 359. If a silver chloride crystal lattice structure receives a net positive charge of +1 by doping, the energy of its conduction band is lowered in the vicinity of the dopant by about 0.048 electron volts (eV). For a net positive charge of +2 the shift is about 0.192 eV.

When photoelectrons are generated by the absorption of light, they are attracted by the net positive charge at the dopant site and temporarily held (i.e., bound or trapped) at the dopant site with a binding energy that is equal to the local decrease in the conduction band energy. The dopant that causes the localized bending of the conduction band to a lower energy is referred to as a shallow electron trap because the binding energy holding the photoelectron at the dopant site (trap) is insufficient to hold the electron permanently at the dopant site. Nevertheless, shallow electron trapping sites are useful. For example, a large burst of photoelectrons generated by a high intensity exposure can be held briefly in shallow electron traps to protect them against immediate dissipation while still allowing their efficient migration over a period of time to latent image forming sites.

For a dopant to be useful in forming a shallow electron trap it must satisfy additional criteria beyond simply providing a net valence more positive than the net valence of the ion or ions it displaces in the crystal lattice. When a dopant is incorporated into the silver halide crystal lattice, it creates in the vicinity of the dopant new electron energy levels (orbitals) in addition to those energy levels or orbitals which comprised the silver halide valence and conduction bands. For a dopant to be useful as a shallow electron trap it must satisfy these additional criteria: (1) its highest energy electron occupied molecular orbital (HOMO, also commonly referred to as the frontier orbital) must be filled—e.g., if the orbital will hold two electrons (the maximum possible number), it must contain two electrons and not one and (2) its lowest energy unoccupied molecular orbital (LUMO) must be at a higher energy level than the lowest energy level conduction band of the silver halide crystal lattice. If conditions (1) and/or (2) are not satisfied, there will be a local, dopant-derived orbital in the crystal lattice (either an unfilled HOMO or a LUMO) at a lower energy than the local, dopant-induced conduction band minimum energy, and photoelectrons will preferentially be held at this lower energy site and thus impede the efficient migration of photoelectrons to latent image forming sites.

Metal ions satisfying criteria (1) and (2) are the following: Group 2 metal ions with a valence of +2, Group 3 metal ions with a valence of 3 but excluding the rare earth elements 58–71, which do not satisfy criterion (1), Group 12 metal ions with a valence of +2 (but excluding Hg, which is a strong desensitizer, possibly because of spontaneous reversion to $Hg^{+1}$), Group 13 metal ions with a valence of +3, Group 14 metal ions with a valence of +2 or +4 and Group 15 metal ions with a valence of +3 or +5. Of the metal ions satisfying criteria (1) and (2) those preferred on the basis of practical convenience for incorporation as dopants include the following period 4, 5 and 6 elements: lanthanum, zinc, cadmium, gallium, indium, thallium, germanium, tin, lead and bismuth. Specifically preferred metal ion dopants satisfying criteria (1) and (2) for use in forming shallow electron traps are zinc, cadmium, indium, lead and bismuth. Specific examples of shallow electron trap dopants of these types are provided by DeWitt U.S. Pat. No. 2,628,167, Gilman et al U.S. Pat. No. 3,761,267, Atwell et al U.S. Pat. No. 4,269,527, Weyde et al U.S. Pat. No. 4,413,055 and Murakima et al EPO 0 590 674 and 0 563 946.

Metal ions in Groups 8, 9 and 10 (hereinafter collectively referred to as Group VIII metal ions) that have their frontier orbitals filled, thereby satisfying criterion (1), have also been investigated. These are Group 8 metal ions with a valence of +2, Group 9 metal ions with a valence of +3 and Group 10 metal ions with a valence of +4. It has been observed that these metal ions are incapable of forming efficient shallow electron traps when incorporated as bare metal ion dopants. This is attributed to the LUMO lying at an energy level below the lowest energy level conduction band of the silver halide crystal lattice.

However, coordination complexes of these Group VIII metal ions as well as $Ga^{+3}$ and $In^{+3}$, when employed as dopants, can form efficient shallow electron traps. The requirement of the frontier orbital of the metal ion being filled satisfies criterion (1). For criterion (2) to be satisfied at least one of the ligands forming the coordination complex must be more strongly electron withdrawing than halide (i.e., more electron withdrawing than a fluoride ion, which is the most highly electron withdrawing halide ion).

One common way of assessing electron withdrawing characteristics is by reference to the spectrochemical series of ligands, derived from the absorption spectra of metal ion complexes in solution, referenced in *Inorganic Chemistry: Principles of Structure and Reactivity*, by James E. Huheey, 1972, Harper and Row, New York and in *Absorption Spectra and Chemical Bonding in Complexes* by C. K. Jorgerisen, 1962, Pergamon Press, London. From these references the following order of ligands in the spectrochemical series is apparent:

$$<H_2O<NCS^-<CH_3CN^-<NH_3<NO_2^-<<CN^-<CO.$$

The efficiency of a ligand in raising the LUMO value of the dopant complex increases as the ligand atom bound to the metal changes from Cl to S to O to N to C. Thus, the ligands $CN^-$ and CO are especially preferred. Other preferred ligands are thiocyanate ($NCS^-$), selenocyanate ($NCSe^-$), cyanate ($NCO^-$), tellurocyanate ($NCTe^-$) and azide ($N_3^-$).

Just as the spectrochemical series can be applied to ligands of coordination complexes, it can also be applied to the metal ions. The following spectrochemical series of metal ions is reported in *Absorption Spectra and Chemical Bonding* by C. K. Jorgensen, 1962, Pergamon Press, London:

$$Mn^{+2}<Ni^{+2}<Co^{+2}<Fe^{+2}<Cr^{+3}\approx V^{+3}<Co^{+3}<Mn^{+4}<Mo^{+3}<Rh^{+3}\approx Ru^{+3}<Pd^{+4}<Ir^{+3}<Pt^{+4}$$

The metal ions in boldface type satisfy frontier orbital requirement (1) above. Although this listing does not contain all the metals ions which are specifically contemplated for use in coordination complexes as dopants, the position of the remaining metals in the spectrochemical series can be identified by noting that an ion's position in the series shifts from $Mn^{+2}$, the least electronegative metal, toward $Pt^{+4}$, the most electronegative metal, as the ion's place in the Periodic Table of Elements increases from period 4 to period 5 to period 6. The series position also shifts in the same direction when the positive charge increases. Thus, $Os^{+3}$, a period 6 ion, is more electronegative than $Pd^{+4}$, the most electronegative period 5 ion, but less electronegative than $Pt^{+4}$, the most electronegative period 6 ion.

From the discussion above $Rh^{+3}$, $Ru^{+3}$, $Pd^{+4}$, $Ir^{+3}$, $Os^{+3}$ and $Pt^{+4}$ are clearly the most electronegative metal ions satisfying frontier orbital requirement (1) above and are therefore specifically preferred.

To satisfy the LUMO requirements of criterion (2) above the filled frontier orbital polyvalent metal ions of Group VIII are incorporated in a coordination complex containing ligands, at least one, most preferably at least 3, and optimally at least 4 of which are more electronegative than halide, with any remaining ligand or ligands being a halide ligand. When the metal ion is itself highly electronegative, such $Os^{+3}$, only a single strongly electronegative ligand, such as carbonyl, for example, is required to satisfy LUMO requirements. If the metal ion is itself of relatively low electronegativity, such as $Fe^{+2}$, choosing all of the ligands to be highly electronegative may be required to satisfy LUMO requirements. For example, $Fe(II)(CN)_6$ is a specifically preferred shallow electron trapping dopant. In fact, coordination complexes containing 6 cyano ligands in general represent a convenient, preferred class of shallow electron trapping dopants.

Since $Ga^{+3}$ and $In^{+3}$ are capable of satisfying HOMO and LUMO requirements as bare metal ions, when they are incorporated in coordination complexes they can contain ligands that range in electronegativity from halide ions to any of the more electronegative ligands useful with Group VIII metal ion coordination complexes.

For Group VIII metal ions and ligands of intermediate levels of electronegativity it can be readily determined whether a particular metal coordination complex contains the proper combination of metal and ligand electronegativity to satisfy LUMO requirements and hence act as a shallow electron trap. This can be done by employing electron paramagnetic resonance (EPR) spectroscopy. This analytical technique is widely used as an analytical method and is described in *Electron SpinResonance:A Comprehensive Treatise on Expetimental Techniques,* 2nd Ed., by Charles P. Poole, Jr. (1983) published by John Wiley & Sons, Inc., New York.

Photoelectrons in shallow electron traps give rise to an EPR signal very similar to that observed for photoelectrons in the conduction band energy levels of the silver halide crystal lattice. EPR signals from either shallow trapped electrons or conduction band electrons are referred to as electron EPR signals. Electron EPR signals are commonly characterized by a parameter called the g factor. The method for calculating the g factor of an EPR signal is given by C. P. Poole, cited above. The g factor of the electron EPR signal in the silver halide crystal lattice depends on the type of halide ion(s) in the vicinity of the electron. Thus, as reported by R. S. Eachus, M. T. Olm, R. Janes and M. C. R. Symons in the journal *Physica Dysyud Solidi(b),* Vol. 152 (1989), pp. 583–592, in a AgCl crystal the g factor of the electron EPR signal is 1.88±0.01 and in AgBr it is 1.49±0.02.

A coordination complex dopant can be identified as useful in forming shallow electron traps in silver halide emulsions if, in the test emulsion set out below, it enhances the magnitude of the electron EPR signal by at least 20 percent compared to the corresponding undoped control emulsion. The undoped control is a 0.34±0.05 μm edge length AgCl cubic emulsion prepared, but not spectrally sensitized, as follows: A reaction vessel containing 5.7 L of a 3.95% by weight gelatin solution is adjusted to 46° C., pH of 5.8 and a pAg of 7.51 by addition of a NaCl solution. A solution of 1.2 grams of 1,8-dihydroxy-3,6-dithiaoctane in 50 mL of water is then added to the reaction vessel. A 2M solution of $AgNO_3$ and a 2M solution of NaCl are simultaneously run into the reaction vessel with rapid stirring, each at a flow rate of 249 mL/min with controlled pAg of 7.51. The double-jet precipitation is continued for 21.5 minutes, after which the emulsion is cooled to 38° C., washed to a pAg of 7.26, and then concentrated. Additional gelatin is introduced to achieve 43.4 grams of gelatin/Ag mole, and the emulsion is adjusted to pH of 5.7 and pAg of 7.50. The resulting silver chloride emulsion has a cubic grain morphology and a 0.34 μm average edge length. The dopant to be tested is dissolved in the NaCl solution or, if the dopant is not stable in that solution, the dopant is introduced from aqueous solution via a third jet.

After precipitation, the test and control emulsions are each prepared for electron EPR signal measurement by first centrifuging the liquid emulsion, removing the supernatant, replacing the supernatant with an equivalent amount of warm distilled water and resuspending the emulsion. This procedure is repeated three times, and, after the final centrifuge step, the resulting powder is air dried. These procedures are performed under safe light conditions.

The EPR test is run by cooling three different samples of each emulsion to 20°, 40° and 60° K., respectively, exposing each sample to the filtered output of a 200 W Hg lamp at a wavelength of 365 nm, and measuring the EPR electron signal during exposure. If, at any of the selected observation temperatures, the intensity of the electron EPR signal is significantly enhanced (i.e., measurably increased above signal noise) in the doped test emulsion sample relative to the undoped control emulsion, the dopant is a shallow electron trap.

As a specific example of a test conducted as described above, when a commonly used shallow electron trapping dopant, $Fe(CN)_6^{4-}$, was added during precipitation at a molar concentration of $50\times10^{-6}$ dopant per silver mole as described above, the electron EPR signal intensity was enhanced by a factor of 8 over undoped control emulsion when examined at 20° K.

Hexacoordination complexes are useful coordination complexes for forming shallow electron trapping sites. They contain a metal ion and six ligands that displace a silver ion and six adjacent halide ions in the crystal lattice. One or two of the coordination sites can be occupied by neutral ligands, such as carbonyl, aquo or ammine ligands, but the remainder of the ligands must be anionic to facilitate efficient incorporation of the coordination complex in the crystal lattice structure. Illustrations of specifically contemplated hexacoordination complexes for inclusion are provided by McDugle et al U.S. Pat. No. 5,037,732, Marchetti et al U.S. Pat. Nos. 4,937,180, 5,264,336 and 5,268,264, and Keevert et al U.S. Pat. No. 4,945,035.

In a specific form it is contemplated to employ as a SET dopant a hexacoordination complex satisfying the formula:

$$[ML_6]^n \quad \text{(V)}$$

where

M is filled frontier orbital polyvalent metal ion, preferably $Fe^{+2}$, $Ru^{+2}$, $Os^{+2}$, $Co^{+3}$, $Rh^{+3}$, $Ir^{+3}$, $pd^{+4}$ or $Pt^{+4}$;

$L_6$ represents six coordination complex ligands which can be independently selected, provided that least four of the ligands are anionic ligands and at least one (preferably at least 3 and optimally at least 4) of the ligands is more electronegative than any halide ligand; and n is −1, −2, −3 or −4.

The following are specific illustrations of dopants capable of providing shallow electron traps:

| | |
|---|---|
| SET-1 | $[Fe(CN)_6]^{-4}$ |
| SET-2 | $[Ru(CN)_6]^{-4}$ |
| SET-3 | $[Os(CN)_6]^{-4}$ |
| SET-4 | $[Rh(CN)_6]^{-3}$ |
| SET-5 | $[Ir(CN)_6]^{-3}$ |
| SET-6 | $[Fe(pyrazine)(CN)_5]^{-4}$ |
| SET-7 | $[RuCl(CN)_5]^{-4}$ |
| SET-8 | $[OsBr(CN)_5]^{-4}$ |
| SET-9 | $[RhF(CN)_5]^{-3}$ |
| SET-10 | $[IrBr(CN)_5]^{-3}$ |
| SET-11 | $[FeCO(CN)_5]^{-3}$ |
| SET-12 | $[RuF_2(CN)_4]^{-4}$ |
| SET-13 | $[OsCl_2(CN)_4]^{-4}$ |
| SET-14 | $[RhI_2(CN)_4]^{-3}$ |
| SET-15 | $[IrBr_2(CN)_4]^{-3}$ |
| SET-16 | $[Ru(CN)_5(OCN)]^{-4}$ |
| SET-17 | $[Ru(CN)_5(N_3)]^{-4}$ |
| SET-18 | $[Os(CN)_5(SCN)]^{-4}$ |
| SET-19 | $[Rh(CN)_5(SeCN)]^{-3}$ |
| SET-20 | $[Ir(CN)_5(HOH)]^{-2}$ |
| SET-21 | $[Fe(CN)_3Cl_3]^{-3}$ |
| SET-22 | $[Ru(CO)_2(CN)_4]^{-1}$ |
| SET-23 | $[Os(CN)Cl_5]^{-4}$ |
| SET-24 | $[CO(CN)_6]^{-3}$ |
| SET-25 | $[Ir(CN)_4(oxalate)]^{-3}$ |
| SET-26 | $[In(NCS)_6]^{-3}$ |
| SET-27 | $[Ga(NCS)_6]^{-3}$ |
| SET-28 | $[Pt(CN)_4(H_2O)_2]^{-1}$ |

Instead of employing hexacoordination complexes containing $Ir^{+3}$, it is preferred to employ $Ir^{+4}$ coordination complexes. These can, for example, be identical to any one of the iridium complexes listed above, except that the net valence is −2 instead of −3. Analysis has revealed that $Ir^{+4}$ complexes introduced during grain precipitation are actually incorporated as $Ir^{+3}$ complexes. Analyses of iridium doped grains have never revealed $Ir^{+4}$ as an incorporated ion. The advantage of employing $Ir^{+4}$ complexes is that they are more stable under the holding conditions encountered prior to emulsion precipitation. This is discussed by Leubner et al U.S. Pat. No. 4,902,611, here incorporated by reference.

The SET dopants are effective at any location within the grains. Generally better results are obtained when the SET dopant is incorporated in the exterior 50 percent of the grain, based on silver. To insure that the dopant is in fact incorporated in the grain structure and not merely associated with the surface of the grain, it is preferred to introduce the SET dopant prior to forming the maximum iodide concentration region of the grain. Thus, an optimum grain region for SET incorporation is that formed by silver ranging from 50 to 85 percent of total silver forming the grains. That is, SET introduction is optimally commenced after 50 percent of total silver has been introduced and optimally completed by the time 85 percent of total silver has precipitated. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

The exposure (E) of a photographic element is the product of the intensity (I) of exposure multiplied by its duration (t):

$$E=IXt \quad \text{(VI)}$$

According to the photographic law of reciprocity, a photographic element should produce the same image with the same exposure, even though exposure intensity and time are varied. For example, an exposure for 1 second at a selected intensity should produce exactly the same result as an exposure of 2 seconds at half the selected intensity. When photographic performance is noted to diverge from the reciprocity law, this is known as reciprocity failure.

When exposure times are reduced below one second to very short intervals (e.g., $10^{-5}$ second or less), higher exposure intensities must be employed to compensate for the reduced exposure times. High intensity reciprocity failure (hereinafter also referred to as HIRF) occurs when photographic performance is noted to depart from the reciprocity law when varied exposure times of less than 1 second are employed. SET dopants are also known to be effective to reduce HIRF.

Iridium dopants that are ineffective to provide shallow electron traps—e.g., either bare iridium ions or iridium coordination complexes that fail to satisfy the more electropositive than halide ligand criterion of formula V above can be incorporated in the iodochloride grains of the invention to reduce reciprocity failure. These iridium dopants are effective to reduce both high intensity reciprocity failure (HIRF) and low intensity reciprocity failure (hereinafter also referred to as LIRF). Low intensity reciprocity failure is the term applied to observed departures from the reciprocity law of photographic elements exposed at varied times ranging from 1 second to 10 seconds, 100 seconds or longer time intervals with exposure intensity sufficiently reduced to maintain an unvaried level of exposure.

The reciprocity failure reducing Ir dopant can be introduced into the silver iodochloride grain structure as a bare metal ion or as a non-SET coordination complex, typically a hexahalocoordination complex. In either event, the iridium ion displaces a silver ion in the crystal lattice structure. When the metal ion is introduced as a hexacoordination complex, the ligands need not be limited to halide ligands. The ligands are selected as previously described in connection with formula V, except that the incorporation of ligands more electropositive than halide is restricted so that the coordination complex is not capable of acting as a shallow electron trapping site.

To be effective for reciprocity improvement the Ir must be incorporated within the high chloride {100} tabular grain structure. To insure total incorporation it is preferred that Ir dopant introduction be complete by the time 99 percent of the total silver has been precipitate. For reciprocity improvement the Ir dopant can be present at any location within the grain structure. A preferred location within the grain structure for Ir dopants reciprocity improvement, is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations. The reason for this is that these dopants form deep electron traps and are capable of decreasing grain sensitivity if employed in relatively high concentrations. These non-SET Ir dopants are preferably incorporated in concentrations of at least $1\times10^{-9}$ mole per silver up to $1\times10^{-6}$ mole per silver mole. However, higher levels of incorporation can be tolerated, up about $1\times10^{-4}$ mole per silver, when reductions from the highest attainable levels of sensitivity can be tolerated. Specific illustrations of useful Ir dopants contemplated for reciprocity failure reduction are provided by B. H. Carroll, "Iridium Sensitization: A Literature Review", *Photographic Science and Engineering,* Vol. 24, No. 6 Nov./Dec. 1980, pp. 265–267; Iwaosa et al U.S. Pat. No. 3,901,711; Grzeskowiak et al U.S. Pat. No. 4,828,962; Kim U.S. Pat. No. 4,997,751; Maekawa et al U.S. Pat. No. 5,134,060; Kawai et al U.S. Pat. No. 5,164,292; and Asami U.S. Pat. Nos. 5,166,044 and 5,204,234.

The contrast of photographic elements containing high chloride {100} tabular grain emulsions of the invention can be further increased by doping the silver iodochloride grains with a hexacoordination complex containing a nitrosyl or thionitrosyl ligand. Preferred coordination complexes of this type are represented by the formula:

$$[TE_4(NZ)E']^r \qquad \text{(VII)}$$

where

T is a transition metal;

E is a bridging ligand;

E' is E or NZ;

r is zero, −1, −2 or −3; and

Z is oxygen or sulfur.

The E ligands can take any of the forms found in the SET dopants and non-SET Ir dopants discussed above. A listing of suitable coordination complexes satisfying formula VII is found in McDugle et al U.S. Pat. No. 4,933,272, the disclosure of which is here incorporatedby reference.

The contrast increasing dopants (hereinafter also referred to as NZ dopants) can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the high chloride {100} tabular grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

It is also recognized that silver salts can be epitaxially grown onto the tabular grains during the precipitation process. Epitaxial deposition onto the edges and/or corners of tabular grains is specifically taught by Maskasky U.S. Pat. No. 5,275,930, here incorporated by reference. In a specifically preferred form high chloride silver halide epitaxy is present at the edges or, most preferably, restricted to corner adjacent sites on the tabular grains.

Although epitaxy onto the host tabular grains can itself act as a sensitizer, the emulsions of the invention show unexpected sensitivity enhancements with or without epitaxy when chemically sensitized in the absence of a gelatino-peptizer, employing one or a combination of noble metal, middle chalcogen and reduction chemical sensitization techniques. Conventional chemical sensitizations by these techniques are summarized in *Research Disclosure,* Item 36544, cited above, Section IV. Chemical sensitizations. All of these sensitizations, except those that specifically require the presence of gelatin (e.g., active gelatin sensitization) are applicable to the practice of the invention. It is preferred to employ at least one of noble metal (typically gold) and middle chalcogen (typically sulfur) and, most preferably, a combination of both in preparing the emulsions of the invention for photographic use.

Between emulsion precipitation and chemical sensitization, the step that is preferably completed before any gelatin or gelatin derivative is added to the emulsion, it is conventional practice to wash the emulsions to remove soluble reaction by-products (e.g., alkali and/or alkaline earth cations and nitrate anions). If desired, emulsion washing can be combined with emulsion precipitation, using ultrafiltration during precipitation as taught by Mignot U.S. Pat. No. 4,334,012. Alternatively emulsion washing by diafiltration after precipitation and before chemical sensitization can be undertaken with a semipermeable membrane as illustrated by *Research Disclosure,* Vol. 102, October 1972, Item 10208, Hagemaier et al *Research Disclosure,* Vol. 131, March 1975, Item 13122, Bonnet *Research Disclosure,* Vol. 135, July 1975, Item 13577, Berg et al German OLS 2,436,461 and Bolton U.S. Pat. No. 2,495,918, or by employing an ion-exchange resin, as illustrated by Maley U.S. Pat. No. 3,782,953 and Noble U.S. Pat. No. 2,827,428. In washing by these techniques there is no possibility of removing the selected peptizers, since ion removal is inherently limited to removing much lower molecular weight solute ions and peptizer adsorbed to grain surfaces cannot be removed by washing.

A specifically preferred approach to chemical sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetrasubstituted middle chalcogen ureas of the type disclosed by Herz et al U.S. Pat. Nos. 4,749,646 and 4,810,626, the disclosures of which are here incorporated by reference. Preferred compounds include those represented by the formula:

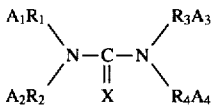

(VIII)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetrasubstituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(IX)}$$

wherein

L is a mesoionic compound;

X is an anion; and $L^1$ is a Lewis acid donor.

In another preferred form of the invention it is contemplated to employ alone or in combination with sulfur sensitizers, such as those formula VIII, and/or gold sensitizers, such as those of formula IX, reduction sensitizers which are the 2-[N-(2-alkynyl)amino]-meta-chalcoazoles disclosed by Lok et al U.S. Pat. Nos. 4,378,426 and 4,451,557, the disclosures of which are here incorporated by reference.

Preferred 2-[N-(2-alkynyl)amino]-meta-chalcoazoles can be represented by the formula:

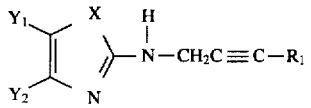

(X)

where

X=O, S, Se;

$R_1$=(Xa) hydrogen or (Xb) alkyl or substituted alkyl or aryl or substituted aryl; and $Y_1$ and $Y_2$ individually represent hydrogen, alkyl groups or an aromatic nucleus or together represent the atoms necessary to complete an aromatic or alicyclic ring containing atoms selected from among carbon, oxygen, selenium, and nitrogen atoms.

The formula X compounds are generally effective (with the Xb form giving very large speed gains and exceptional latent image stability) when present during the heating step (finish) that results in chemical sensitization.

Spectral sensitization of the emulsions of the invention is not required, but is highly preferred, even when photographic use of the emulsion is undertaken in a spectral region in which the tabular grains exhibit significant native sensitivity. While spectral sensitization is most commonly undertaken after chemical sensitization, spectral sensitizing dye can be advantageous introduced earlier, up to and including prior to grain nucleation. Kofron et al discloses advantages for "dye in the finish" sensitizations, which are those that introduce the spectral sensitizing dye into the emulsion prior to the heating step (finish) that results in chemical sensitization. Maskasky U.S. Pat. No. 4,435,501 teaches the use of aggregating spectral sensitizing dyes, particularly green and red absorbing cyanine dyes, as site directors for epitaxial deposition. These dyes are present in the emulsion prior to the chemical sensitizing finishing step. When the spectral sensitizing dye present in the finish is not relied upon as a site director for the silver salt epitaxy, a much broader range of spectral sensitizing dyes is available. The spectral sensitizing dyes disclosed by Kofron et al, particularly the blue spectral sensitizing dyes shown by structure and their longer methine chain analogous that exhibit absorption maxima in the green and red portions of the spectrum, are particularly preferred for incorporation in the tabular grain emulsions of the invention. A more general summary of useful spectral sensitizing dyes is provided by *Research Disclosure*, Item 36544, cited above, Section V. Spectral sensitization and desensitization.

While in specifically preferred forms of the invention the spectral sensitizing dye can act also as a site director and/or can be present during the finish, the only required function that a spectral sensitizing dye must perform in the emulsions of the invention is to increase the sensitivity of the emulsion to at least one region of the spectrum. Hence, the spectral sensitizing dye can, if desired, be added to an emulsion according to the invention after chemical sensitization has been completed.

At any time following chemical sensitization and prior to coating additional vehicle is added to the emulsions of the invention. Conventional vehicles and related emulsion components are illustrated by *Research Disclosure*, Item 36544, cited above, Section II. Vehicles, vehicle extenders, vehicle-like addenda and vehicle related addenda.

Aside from the features described above, the emulsions of this invention and their preparation can take any desired conventional form. For example, although not essential, after a novel emulsion satisfying the requirements of the invention has been prepared, it can be blended with one or more other novel emulsions according to this invention or with any other conventional emulsion. Conventional emulsion blending is illustrated in *Research Disclosure*, Item 36544, Section I. Emulsion grains and their preparation, E. Blends, layers and performance categories. Other common, but optional features are illustrated by *Research Disclosure*, Item 36544, Section VII, Antifoggants and stabilizers; Section VIII, Absorbing and scattering materials; Section IX, Coating physical property modifying agents; Section X, Dye image formers and modifiers. The features of Sections II and VII–X can alternatively be provided in other photographic element layers.

The photographic applications of the emulsions of the invention can encompass other conventional features, such as those illustrated by *Research Disclosure*, Item 36544, Sections:

XI. Layers and layer arrangements
XII. Features applicable only to color negative
XIII. Features applicable only to color positive
XIV. Scan facilitating features
XV. Supports
XVI. Exposure
XVII. Physical development systems
XVIII. Chemical development systems
XIX. Development
XX. Desilvering, washing, rinsing and stabilizing (post-development)

The high chloride {100} tabular grain emulsions of this invention can be employed in any otherwise conventional photographic element. The emulsions can, for example, be included in a photographic element with one or more silver halide emulsion layers. In one specific application a novel emulsion according to the invention can be present in a single emulsion layer of a photographic element intended to form either silver or dye photographic images for viewing or scanning. The high chloride {100} tabular grain emulsions of this invention can be incorporated in black-and-white photographic elements (those intended to form silver images), in radiographic elements (those intended to be exposed directly by X-radiation or indirectly by X-radiation using intensifying screens), and in color photographic elements (those intended to form dye images), including camera speed (taking) films and reflection print elements intended to form images for direct viewing. The color photographic elements are preferably multicolor photographic elements capable of forming yellow, magenta and cyan dye images.

EXAMPLES

The invention can be better appreciated by reference to the following specific examples.

Preparation of Oxidized Cationic Starch

Solution A

A cationic starch solution (CS-1) was prepared by boiling for 30 minutes a stirred mixture of 8.0 g cationic potato starch-to which distilled water was added to create a volume of 400 mL. The starch, STA-LOK® 400, was obtained from A. E. Staley Manufacturing Co., Decatur, Illinois, U.S.A. It is a mixture of 21% amylose and 79% amylopectin, 0.33 wt % nitrogen in the form of quaternary trimethyl ammonium alkyl starch ether, 0.13 wt % natural phosphorus, average molecular weight 2.2 million.

The resulting cationic starch solution CS-1 was cooled to 40° C., readjusted to 400 mL with distilled water, and the pH adjusted to 7.9 with solid $NaHCO_3$. With stirring, 5.0 mL of a NaOCL solution (containing 5 wt % chlorine) was added with dilute $HNO_3$ to maintain the pH between 6.5 and 7.5. Then the pH was adjusted to 7.75 with saturated $NaHCO_3$ solution. The stirred solution was heated at 40° C. for 3 hours. The solution was adjusted to a pH of 5.5.

EXAMPLE 1

To a vigorously stirred reaction vessel containing 400 g of Solution A, the oxidized cationic starch solution prepared above, at 60° C., pH 5.5 was added 2.5M $AgNO_3$ solution at a rate of 1.0 mL per minute for 5 minutes, then its rate of addition was accelerated to 2.7 mL/min during 40 minutes. A total of 0.2 mole of silver was added. Concurrently, a solution of 2.5M NaCl was added at a rate needed to maintain a pCl of 0.89. During the precipitation, the DH was maintained at 5.5.

The tabular grain population of the resulting emulsion was comprised of AgCl {100} tabular grains with an average ECD of 2.0 μm, an average thickness of 0.16 μm, and an average aspect ratio of 12.5. The tabular grain population accounted for 40% of the total projected area of the emulsion grains.

Comparative Failure 1

Example 1 was repeated, except that the cationic starch CS-1 solution, adjusted to the same pH, was substituted for Solution A, the oxidized cationic starch solution.

No tabular grains of any type were observed in the final emulsion.

EXAMPLE 2

This emulsion was prepared similar as Example 1, except that the precipitation was stopped after a total of 0.10 mole of silver was precipitated.

The tabular grain population of the resulting emulsion was comprised of AgCl {100} tabular grains with an average ECD of 1.8 μm, an average thickness of 0.15 μm, and an average aspect ratio of 12. The tabular grain population accounted for >30% of the total projected area of the emulsion grains.

Comparative Failure 2

Example 2 was repeated, except that the cationic starch CS-1 solution, adjusted to the same pH, was substituted for Solution A, the oxidized cationic starch solution.

No tabular grains of any type were observed in the final emulsion.

Discussion of Results

The examples and failures above demonstrate that cationic starch when employed as a peptizer does not allow high chloride grains to be precipitated as tabular grains having {100} major faces. On the other hand, when the cationic starch is oxidized, at least 30 percent of total grain projected area can be precipitated in the form of {100} tabular grains.

EXAMPLE 3

AgCl {100} T-Grain Emulsions Made Using Oxidized Cationic Amylopectin Starch STA-LOK® 140 was obtained from A. E. Staley Manufacturing Co., Decatur, Il. It is nearly pure amylopectin obtained from the genetic variety of corn known as waxy corn. It was made cationic with 0.35 wgt % nitrogen substitution in the form of a quaternary trimethyl ammonium alkyl starch ether, oxidized using 2 wgt % chlorine bleach, and washed. A 2% solution of this starch had a conductivity of 390 μS. Elemental analysis showed it to contain 0.037 wgt % sulfur and 0.008 wgt % phosphorus.

A starch solution was prepared by heating at 80° C. for 30 mina stirred mixture of 8 g STA-LOK ® 140, 12 mmoles of NaCl, and distilled water to 400 g.

To a vigorously stirred reaction vessel of the starch solution at 85° C., pH 6.0, a 4M $AgNO_3$ solution was added at 5.0 mL per min for 20 min. Concurrently, a 4M NaCl solution was added at a rate needed to maintain a pCl of 1.52.

The tabular grain population of the resulting tabular grain emulsion was comprised of {100} AgCl tabular grains with an average equivalent circular diameter of 3.5 μm, an average thickness of 0.16 μm, and an average aspect ratio of 22. The {100} tabular grain population made up 60% of the total projected area of the emulsion grains.

EXAMPLE 4

AgCl{100} T-Grain Emulsions Made Using Oxidized Cationic Amylopectin Starch

A starch solution was prepared as described in Example 3 containing 12 moles of NaCl.

To a vigorously stirred reaction vessel of the starch solution at 85° C., pH 6.0, a 4M $AgNO_3$ solution was added at 5.0 mL/min for 5 min. Concurrently, a 4M NaCl solution was added at a rate needed to maintain a pCl of 1.52. After 5 min, the additions were stopped for 10 min then a 2M $AgNO_3$ solution was added at 2.5 mL/min for 30 min. Concurrently, a 4M NaCl solution was added at a rate needed to maintain a pCl of 1.52.

The tabular grain population of the resulting tabular grain emulsion was comprised of {100} AgCl tabular grains with an average equivalent circular diameter of 5.0 μm, an average thickness of 0.18 μm, and an average aspect ratio of 28. The {100} tabular grain population made up 60% of the total projected area of the emulsion grains.

The invention has been described in detail with particular reference to preferred embodiments thereof, but it will be understood that variations and modifications can be effected within the spirit and scope of the invention.

What is claimed is:

1. A radiation-sensitive emulsion comprised of silver halide grains including tabular grains (a) having {100} major faces, (b) containing greater than 50 mole percent chloride, based on silver, (c) accounting for greater than 30 percent of total grain projected area, (d) exhibiting an average thickness of less than 0.3 μm, and (e) exhibiting an average aspect ratio of greater than 5, and a dispersing medium including a peptizer adsorbed to the silver halide grains, wherein the peptizer is a water dispersible oxidized cationic starch.

2. A radiation-sensitive emulsion according to claim 1 wherein the oxidized cationic starch is comprised of at least one of α-amylose and amylopectin.

3. A radiation-sensitive emulsion according to claim 1 wherein the oxidized cationic starch consists essentially of oxidized amylopectin cationic starch.

4. A radiation-sensitive emulsion according to claim 1 wherein the oxidized starch contains cationic moieties selected from among protonated amine moieties and quaternary ammonium, sulfonium and phosphonium moieties.

5. A radiation-sensitive emulsion according to claim 1 wherein the oxidized cationic starch contains α-D-glucopyranose repeating units and, on average, at least one oxidized α-D-glucopyranose unit per starch molecule.

6. A radiation-sensitive emulsion according to claim 5 wherein at least 1 percent of the α-D-glycopyranose units are ring opened by oxidation.

7. A radiation-sensitive emulsion according to claim 6 wherein from 3 to 50 percent of the α-D-glycopyranose units are ring opened by oxidation.

8. A radiation-sensitive emulsion according to claim 6 wherein the oxidized α-D-glucopyranose units contain two —C(O)R groups, where R completes an aldehyde or carboxyl group.

9. A radiation-sensitive emulsion according to claim 8 wherein the oxidized α-D-glucopyranose units are dialdehydes.

10. A radiation-sensitive emulsion according to claim 1 wherein the oxidized cationic starch contains α-D-glucopyranose repeating units having 1 and 4 position linkages.

11. A radiation-sensitive emulsion according to claim 10 wherein the oxidized cationic starch additionally contains 6 position linkages in a portion of the α-D-glucopyranose repeating units to form a branched chain polymeric structure.

12. A radiation-sensitive emulsion according to claim 1 wherein the tabular grains contain at least 90 mole percent chloride, based on silver.

13. A radiation-sensitive emulsion according to claim 1 wherein the oxidized cationic starch is dispersed to at least a colloidal level of dispersion.

14. A radiation-sensitive emulsion according to claim 13 wherein the oxidized cationic starch is at least in part present as an aqueous solute.

15. A radiation-sensitive emulsion according to claim 1 wherein the peptizer consists essentially of the oxidized cationic starch.

16. A radiation-sensitive emulsion according to claim 15 wherein the tabular grains are chemically sensitized.

17. A radiation-sensitive emulsion according to claim 16 wherein the tabular grains are chemically sensitized with at least one of sulfur, gold and reduction sensitizers.

18. A radiation-sensitive emulsion according to claim 16 wherein a photographic vehicle is combined with the chemically sensitized tabular grains.

19. A radiation-sensitive emulsion according to claim 18 wherein the photographic vehicle includes gelatin or a gelatin derivative.

* * * * *